United States Patent [19]

Coppock

[11] Patent Number: 4,540,174

[45] Date of Patent: Sep. 10, 1985

[54] GAME OF CHANCE PARTICULARLY ADAPTED FOR PLAY IN CONJUNCTION WITH A TEAM SPORT CONTEST

[76] Inventor: C. Wallace Coppock, 620 E. Washington St., Petaluma, Calif. 94952

[21] Appl. No.: 601,011

[22] Filed: Apr. 16, 1984

[51] Int. Cl.[3] ..... A63F 9/00

[52] U.S. Cl. ..... 273/138 R; 273/138 A; 273/139

[58] Field of Search ..... 273/139, 138, 85 R, 273/85 G, 94, 87, 93, 1 R, 1 E, 1 G, 1 GC, DIG. 28; 283/100–102

[56] References Cited

U.S. PATENT DOCUMENTS

| | | | |
|---|---|---|---|
| 3,055,117 | 9/1962 | Bernstein et al. | 283/102 X |
| 3,212,780 | 10/1965 | Jewell | 273/139 X |
| 3,826,499 | 7/1974 | Lenkoff | 273/139 X |
| 3,918,174 | 11/1975 | Miller et al. | 283/102 X |
| 4,019,737 | 4/1977 | Witzel | 273/94 |
| 4,034,987 | 7/1977 | Kelley | 273/139 X |
| 4,141,548 | 2/1979 | Everton | 273/DIG. 28 X |
| 4,466,614 | 8/1984 | Bachman et al. | 273/139 |
| 4,491,319 | 1/1985 | Nelson | 273/139 X |

OTHER PUBLICATIONS

Kellogg's Sports Game, 1–1974.
The Great Guinness Game, 2–1983.

*Primary Examiner*—Paul E. Shapiro
*Attorney, Agent, or Firm*—Melvin R. Stidham

[57] ABSTRACT

A game of chance designed to be played in conjunction with a team sport being broadcast wherein the performance of a particular player or position is matched against actual performance, for example, if particular players picked by chance to make the first and last scores in a period, actually do so, a match is made. Other criteria are limitations on opponent's scoring, the position scoring the most points and the like.

12 Claims, 6 Drawing Figures

GAME OF CHANCE PARTICULARLY ADAPTED FOR PLAY IN CONJUNCTION WITH A TEAM SPORT CONTEST

BACKGROUND OF THE INVENTION

This is variation of the game of chance described and claimed in my U.S. Pat. No. 4,429,877 granted Feb. 7, 1984.

Many team sports events are being broadcast by television or radio with advertising time being paid for by commercial sponsors. Accordingly, it is to the great advantage of the broadcasting medium and its sponsors both to attract and to hold the viewer's interest throughout the game so that they will have maximum exposure to their commercial messages. However, if the sporting event lags in interest as by reason of a one-sided score, there is a great tendency for viewers to switch stations or to seek other means of entertainment.

OBJECTS OF THE INVENTION

It is an object of this invention to provide a game of chance designed to attract a person's attention to a broadcast of a team sport contest.

It is a further object of this invention to provide a game of chance to be played in conjunction with a team sport contest and designed to hold one's interest throughout the length of the game.

It is a further object of this invention to provide a game of chance, the results of which are dependent upon events taking place in the sports contest itself.

Other objects and advantages of this invention will become apparent from the description to follow, particularly when viewed in conjunction with the accompanying drawings.

SUMMARY OF THE INVENTION

In carrying out this invention I provide a plurality of game cards marked with at least one row of spaces for each period of play. Within each space is marked at random a symbol representing some characteristic of a scoring play, a particular player's performance, as for example the type of play from scrimmage in the case of football. During a commercial break at the beginning of a period a signal is transmitted identifying the particular space or spaces to apply to that period. On a particular player's card the space identified may show an "R", and if the first score made by the home team during that period is on a running play the player has a match. In football there may be two rows of spaces during each period and if the next space identified shows a "P" and the last score made by the home team during that period is on a pass play the player has another match. Another row of spaces may represent maximum scores to be made by an opponent during that period and, if the space identified for that period shows an "8" for example, the player will have a match only if the home team holds the visitors to 8 points or less. Similar situations can be arranged for other sports such as showing the position in basketball from which the most points are scored; the position in hockey from which the first and last goals during a period are scored; or the manner in which a given batter during an inning of baseball safely reaches base and the like.

DESCRIPTION OF THE PREFERRED EMBODIMENTS

Figure 1:
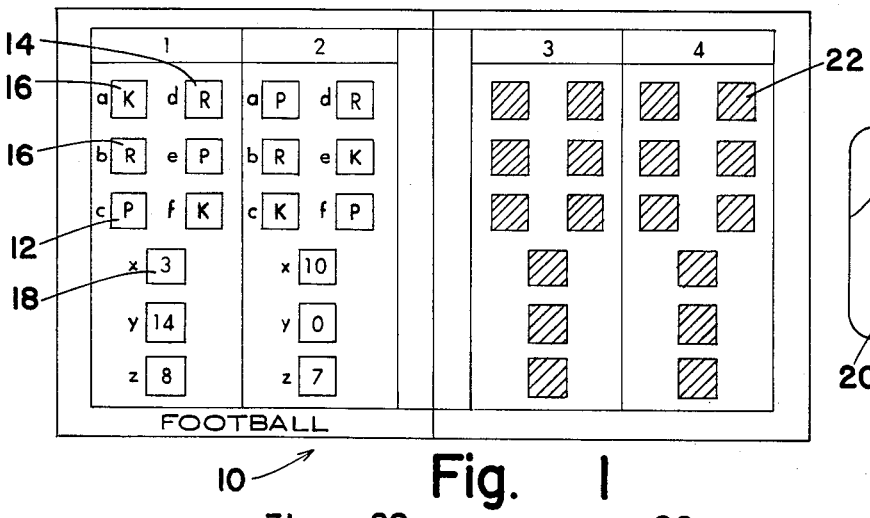
FIG. 1 is a top plan view of a game card for use in conjunction with a football game.

The Embodiment of FIG. 1

Figure 1A:
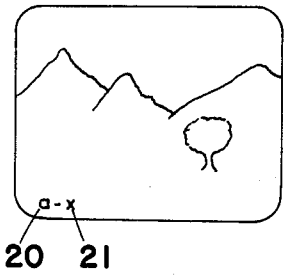
FIG. 1A is a view of a television screen.

Referring now to FIG. 1 with greater particularity, there is shown a game card 10 for use with a game of American football. In each period marked 1, 2, 3 and 4 there are two rows of boxes 12 and 14. In each box 12 and 14, there is marked at random a symbol 16 representing a type of play from scrimmage, "K" representing a kick, "R" representing a run and "P" representing a pass. A third row of boxes 18 in each period carries a number representing the maximum points to be scored by the opponent during that period. During a commercial break in a football game being broadcast by radio or television 20 (FIG. 1A) a signal is transmitted indicating the particular space to apply to the first score made by the home team during that period of play. Simultaneously or separately, another signal 21 is transmitted indicating a particular space for the visitors performance to apply to that period of play. On a particular game player's card space marked "b" may indicate a run and he has a match only if the first score made by the home team during that period is on a running play. Of course, the rules could be extended so that a "running play" includes a return of a kickoff or punt.

The second signal transmitted during each period reflects the number of points to be allowed to the opponent and if space marked "y" is identified as the applicable space the particular player's card shows a match if the opponent scores no more than 14 points It is obvious, that in order to prevail in the game of chance, the player has to hold his attention throughout the period, first, to receive the signal identifying the space to apply, and second, to determine the type of play from scrimmage and total opponent scores during that period.

In the alternative, each space may be masked as shown at the right hand side of FIG. 1 by a removable ink 22 or the like so that the player may scrape away the ink on one space only for each event to see if he can make a match by self-selection.

Figure 2:
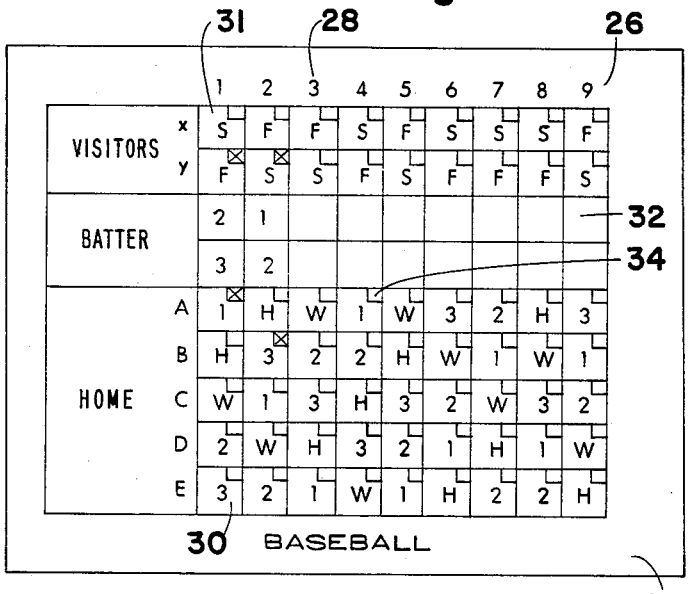
FIG. 2 is a top plan view of a card for use in a baseball game.
Figure 2A:
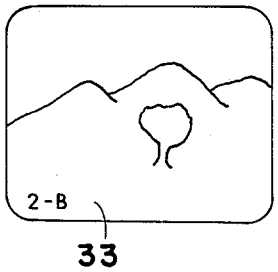
FIG. 2A is a view of a television screen with a visual signal.

The Embodiment of FIG. 2

In the baseball game depicted in FIG. 2, the playing card 24 is set out in nine rows 26, each marked at 28 to represent a inning of regular play. Five spaces in each row 30 are marked to depict the ways in which a batter may safely reach base the numbers "1", "2" and "3", representing single, double and triple, respectively, and the letters "H" and "W" representing a homerun and walk. The top two spaces 31 in each row represent the visitors performance, and are marked with "S" and "F" to represent strike out or an out by a fielder's play such as catching a fly or pop-up or fielding a grounder and throwing out the batter. The middle two spaces 32 are left blank to be filled in by the card player.

During a commercial break before each half inning there will be transmitted a number to represent one of the three players certain to bat in an inning and a letter to indicate the space in the row for that inning against which his performance will be matched. These signals may be transmitted simultaneously or during different commercials. For example, on the television screen 33 is transmitted the message 2-B which means that the second batter in the inning must perform in accordance with the symbol shown in row B. That is, if the second batter to appear in the second inning hits a triple the card player will have a match. In the previous half inning, the signal 1-y may have been transmitted and the card player would have had a match if the first batter in the opponent's side had struck out. A small box 34 may be provided in each space so that the player can mark the space called out by the transmitted signal and, of course, he can put an additional mark in the space if he succeeds in getting a match.

Figure 3:
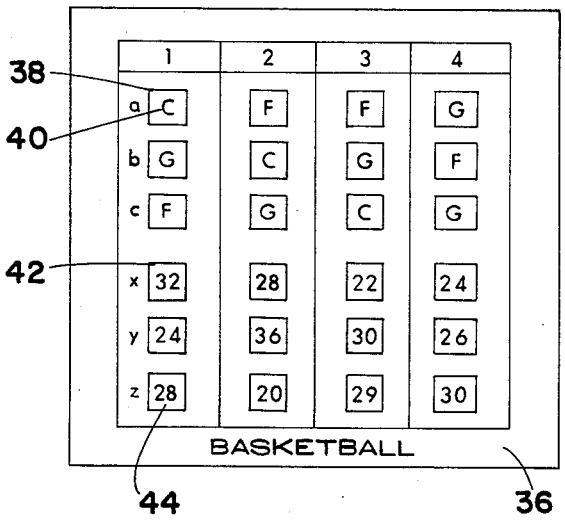
FIG. 3 is a top plan view of a card for use in a basketball game.

The Embodiment of FIG. 3

In the basketball game card 36, a first row of spaces 38, marked "a", "b", and "c" contain symbols 40 therein to represent the players on the home team. A second row of spaces 42, marked "x", "y" and "z" have numbers 44 therein to indicate the maximum number of points to be scored by the opposing team during that given period. For example, if the signal transmitted prior to the first period is a "b" then the shooting performance by the guards is measured and if the most points in that quarter are scored by the guards the player has a match. Similarly, if the defensive signal "x" is given a match is scored if the opposing team fails to score more than 32 points. Since a basketball team includes two forwards and two guards and only one center, the rules will permit introducing a factor of, say two, to be applied to the center's performance. That is, his point score will be doubled in determining the position scoring the most points in a given quarter. Again, as in other embodiments of this invention the spaces 38 may be masked so that the position to be monitored is determined by removing the masking ink.

Figure 4:
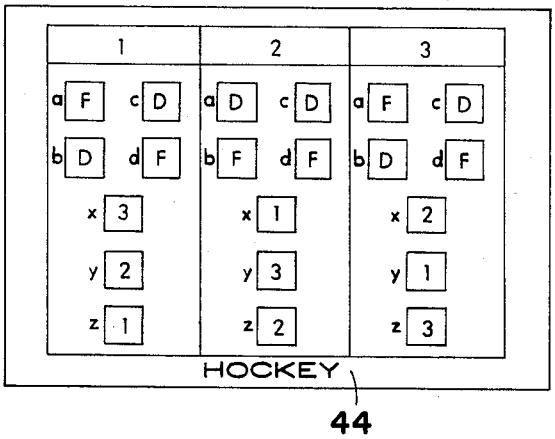
FIG. 4 is a plan view of a card for use in a hockey game.

The Embodiment of FIG. 4

In the hockey card 44 shown in FIG. 4, there are two rows of spaces marked "a" and "b" to represent the basic positions on the team, i.e. forward line or defenseman and a match may be made if the selected position scores the first goal and another match made if the selected position scores the last goal of a given period. Also to be determined in squares marked "x", "y" and "z" are the maximum points to be scored by the opposing team, as in the basketball and football cards.

It is obvious that cards similar to those described and illustrated herein may be provided for soccer and other team sports.

While this invention has been described in conjunction with preferred embodiments thereof, it is obvious that modification and changes therein may be made by those skilled in the art without departing from the spirit and scope of this invention, as defined by the claims appended hereto.

What is claimed as invention is:

1. A game of chance to be played in conjunction with a team sport contest being broadcast and designed to attract and hold one's attention to said contest and to intermittent commercials broadcast throughout, said game comprising:

a plurality of game cards marked with at least one row of spaces for each period of said contest;

a plurality of symbols, each representing a scoring feature that might occur during said contest;

each of said cards being individually marked with one of said symbols placed at random in each of said spaces; and broadcast signal means transmitted during a commercial break identifying the particular space in said one row representing the next contest period to match against a corresponding scoring feature characteristic during said next period.

2. The game of chance defined by claim 1 wherein:

each period is a time period of play; and each symbol represents a characteristic of a score made during a period of play.

3. The game of chance defined by claim 2 wherein:

there are two rows of spaces for each period of play to represent the first and last scores made by one team in said period.

4. The game of chance defined by claim 3 wherein:

said team sport contest is a baseball game with each period comprising an inning thereof: and wherein:

each of said symbols represents a way of reaching base safely.

5. The game of chance defined by claim 2 wherein:

there is another row of spaces for each period to represent the maximum number of points scored by the other team in said period.

6. The game of chance defined by claim 2 wherein:

said contest is a game of American football being televised and each event comprises a quarter period thereof; and wherein:

each symbol indicates a type of play from scrimmage on which a score is made.

7. The game of chance defined by claim 2 wherein:

each symbol indicates the field position of the player making such score.

8. The game of chance defined by claim 2 wherein:

said sport contest is a game of American basketball being televised and each event comprises a quarter period thereof; and wherein:

each of said symbols indicates the player position from which the most points are scored during a period.

9. The game of chance defined by claim 7 including:

a place in each said inning space row in which is to be designated one of the three players of one team certain to bat in said inning;

the identity of said one player being identified by said broadcast signal occurring during a commercial break prior to the half inning in which said one team is at bat.

10. The game of chance defined by claim 9 including:

an additional row of spaces for each inning with further symbols therein to indicate a manner in which a batter may be put out.

11. The game of chance defined by claim 1 wherein:

each period is a time period of play; and each symbol represents a characteristic of a score made during a period of play.

12. A game of chance to be played in conjunction with a team sport contest being viewed and designed to attract and hold one's attention to said contest and to intermittent announcements throughout, said game comprising:

a plurality of game cards marked with at least one row of spaces for each period of said contest;

a plurality of symbols, each representing a scoring feature that might occur during said contest;

each of said cards being individually marked with one of said symbols placed at random in each of said spaces; and announcements transmitted at intervals identifying the particular space in said one row representing the next contest period to match against a corresponding scoring feature characteristic during said next period.

* * * * *